US005215262A

United States Patent [19]

Binder

[11] Patent Number: 5,215,262

[45] Date of Patent: Jun. 1, 1993

[54] METHOD AND APPARATUS FOR COMMINUTING BULK MATERIALS

[75] Inventor: Ulrich Binder, Ennigerloh, Fed. Rep. of Germany

[73] Assignee: O&K Orenstein & Koppel AG, Berlin, Fed. Rep. of Germany

[21] Appl. No.: 720,756

[22] PCT Filed: Dec. 2, 1989

[86] PCT No.: PCT/EP89/01465

§ 371 Date: Jul. 1, 1991

§ 102(e) Date: Jul. 1, 1991

[87] PCT Pub. No.: WO90/07379

PCT Pub. Date: Jul. 12, 1990

[30] Foreign Application Priority Data

Dec. 29, 1988 [DE] Fed. Rep. of Germany ..... 3844178

[51] Int. Cl.[5] ..... B02C 23/32

[52] U.S. Cl. ..... 241/19; 241/24; 241/48; 241/52; 241/61; 241/80; 241/275

[58] Field of Search ..... 241/19, 24, 48, 52, 241/61, 79.1, 80, 275

[56] References Cited

U.S. PATENT DOCUMENTS

| | | | |
|---|---|---|---|
| 2,985,391 | 5/1961 | Parmele | 241/275 |
| 3,155,326 | 11/1964 | Rhodes | 241/275 X |
| 3,162,382 | 12/1964 | Danyluke | 241/275 X |
| 3,524,544 | 8/1970 | Jäger . | |
| 3,951,245 | 4/1976 | Hench, Sr. et al. . | |
| 3,995,784 | 12/1976 | de los Santos Izquierdo | 241/275 |
| 4,575,013 | 3/1986 | Bartley . | |
| 4,799,595 | 1/1989 | Binder . | |
| 4,844,354 | 7/1989 | Watajima | 241/275 X |

FOREIGN PATENT DOCUMENTS

| | | | |
|---|---|---|---|
| 1607623 | 10/1970 | Fed. Rep. of Germany . | |
| 3230824 | 3/1984 | Fed. Rep. of Germany . | |
| 161906 | 2/1932 | Switzerland . | |
| 400354 | 2/1974 | U.S.S.R. | 241/275 |
| 1292828 | 2/1987 | U.S.S.R. | 241/152 R |
| 1299620 | 3/1987 | U.S.S.R. | 241/275 |
| 1375319 | 2/1988 | U.S.S.R. | 241/275 |

*Primary Examiner*—Mark Rosenbaum
*Assistant Examiner*—Frances Chin
*Attorney, Agent, or Firm*—Spencer, Frank & Schneider

[57] ABSTRACT

A process and device for crushing bulk materials. The material to be crushed is fed from above to a first accelerating device which accelerates it into a first crusher, the fine particles in the crushed material produced by the first crusher being carried upwards by an air or gas stream. The larger particles trickle downwards and are then carried by an air or gas stream vertically upwards to another accelerating device which accelerates them into another crusher. The fine particles produced in the second crusher are swept upwards by the air or gas stream, while the larger particles trickle downwards and are brought round to the beginning of the cycle again. The invention concerns the combination of a vertical impact crusher with a separator, both of which are preferably located inside the same housing.

13 Claims, 1 Drawing Sheet

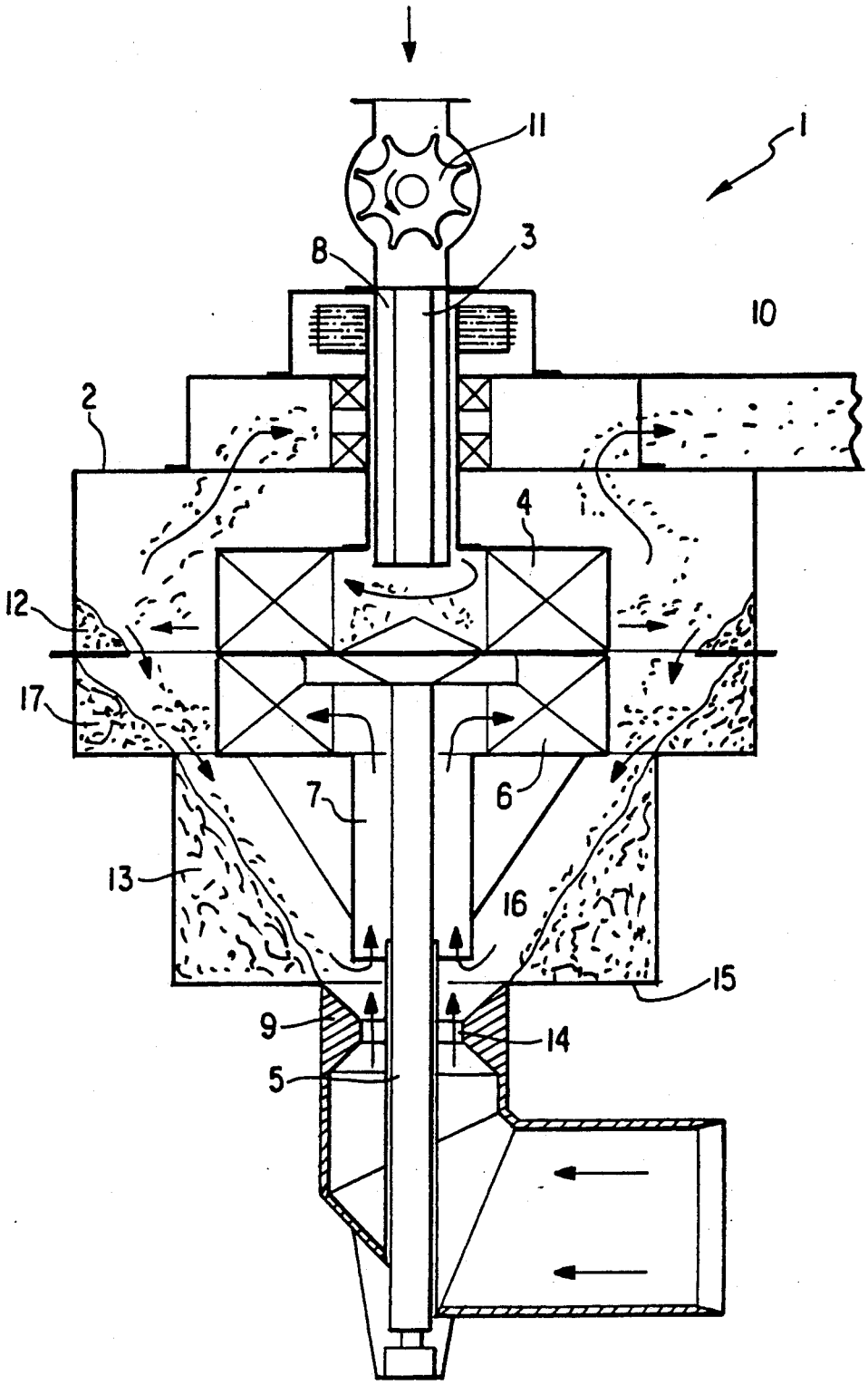
11
1
8
3
10
2
4
12
17
7
6
13
16
15
9
14
5

METHOD AND APPARATUS FOR COMMINUTING BULK MATERIALS

The invention relates to a method of comminuting bulk materials wherein the material is introduced vertically from the top into a comminuting device [and is discharged following the comminution process.] from where it is introduced into a pile of material, with the fine-grained comminution products from this comminution process being discharged by means of an upwardly directed stream of air or gas and coarse grains flow to the bottom and are recirculated.

The general prior art includes so-called vertical impact crushers which are essentially configured of a feeder device in conjunction with a centrifugal wheel arranged concentrically around the drive shaft. The material is usually charged in at the top and is arranged by the centrifugal wheel in a concentric pile, with the motion energy of the accelerated charged-in particles being converted into comminuting work. The discharged material of the conventional vertical impact crushers also contains grain sizes which are not or only insufficiently comminuted. Particularly if the vertical impact crushers are employed as ore-comminution assemblies for ball mills, this results in the drawback that the use of coarse grinding bodies for comminuting these insufficiently pre-comminuted grain sizes from the vertical impact crusher are still required. To overcome this drawback, it is necessary to screen the material discharged from the vertical impact crusher and return the oversize grains for further comminution. This mode of operation has the drawback that a simple and rather malfunction-free comminution assembly becomes complicated and accordingly subject to malfunction due to the addition of transporting paths and classifiers. Another drawback is the considerably greater amount of space that is required.

German Patent No. DE-C 3,230,824 discloses a drying mill with pre-comminution. In this drying mill, a bottomless pre-comminuting assembly is combined with a subsequent tube mill through which flows hot gas and which serves as the fine grinding mill whose discharge conduit leads to a separator. The bottomless pre-comminuting assembly is equipped with a grate to limit grain sizes. The drawbacks of such a system are essentially that with insufficient pre-comminution the material above a certain grain size must be resupplied in a complicated manner to the intake chute of the pre-comminution system before it can be subjected to further screening. Another drawback is that the pre-comminution is able to yield only a relatively coarse fraction so that the subsequent tube mill must be designed to have at least two stages, that is, the amount of energy required for the fine grinding is relatively high.

German Patent No. DE-C 3,545,691 discloses a device for classifying dust-like bulk materials, particularly ground clinker, limestone or raw material for cement by separating in air. The material to be classified is fed onto the cover plate of a cylindrical rotor and is charged into an annularly cylindrical separating chamber extending between the rotor and a stationary blade ring surrounding the rotor. While the coarse material drops to the bottom in the separating chamber, the fine material is transported into the interior of the rotor and is fed into a subsequently connected separator device for separating the fine material and the separating air. To reduce energy consumption and simplify construction, the separating air carrying the fine material is discharged vertically downwardly by means of a pipe disposed below the rotor. The rotor as well as the blade ring are combined in the manner of building blocks of several identical sections. Such a device is not suitable for comminution but only for the separation of coarse and fine bulk components. Here again, another external comminution assembly must be provided to re-comminute the components separated as coarse material so that they can be introduced into the separator.

EP-A 102,742 discloses a vertical impact crusher for minerals. The material is charged laterally from the too and is introduced into a pile disposed radially opposite a centrifugal plate. From there it flows downward and forms another pile of material below the centrifugal plate. An upwardly directed stream of gas or air conducts the coarser material into the region of the centrifugal plate which includes it in the already mentioned pile of material. This is where the actual comminution work takes place, with the sufficiently comminuted products being discharged toward the too through at least one further pipeline, while the coarser material drops back down again. The discharged coarse material must here be picked up by external conveying members and returned to the material intake.

FR-B 1,607,623 discloses a grinding system for moist material in which the ground materials discharged from a preliminary crusher and from a fine mill are charged into a separator, from where the oversize grains are returned to the fine mill. The dry material from the fine mill is charged into the upper portion of the separator and the moist material from the preliminary crusher is charged into the lower portion of the separator, with the moist material being penetrated by hot oases and thus being subjected to drying. A comminution process with return of the coarse material into the comminution process is not provided here.

Additionally, EP-A 140,613 discloses a method as well as an apparatus for comminuting and separating solids. The material is charged in laterally above a funnel (bunker) which feeds it into a rotor disposed therebelow. The rotor flings the material into a radially oppositely disposed pile in which the comminuting work takes place. Coarse material is discharged toward the bottom and is returned by external conveying means (conveyor belts, bucket mechanisms or the like) to the material intake. Fine-grained material is conducted upward by the stream of air generated by the rotor and is classified by means of a separator. The material separated here as being too coarse is returned to the funnel (bunker). Due to the need for external conveying means, this apparatus must be considered to be expensive and uneconomical.

Based on EP-A 140,613, it is the object of the invention to provide a method and an apparatus for comminuting bulk materials with which an optimum comminution process can be realized with the least amount of apparatus, that is, without external conveying means.

This is accomplished [with respect to the method] in that [the material is supplied to a first accelerator device which produces a first pile of material, with fine-grained comminution products from this first comminution process being discharged by a stream of air or gas;] the coarse grains [drop down to the bottom and] are supplied by means of an upwardly directed stream of air or gas to [at least one further] a further accelerator which introduces the material into a further corresponding pile[s] of material, with the fine-grained comminution products obtained after the comminution work in this second stage being discharged by the upwardly directed stream of air or gas while the coarse grains drop down and are [again put into circulation] introduced into the second accelerator device. With this measure it is ensured that the materials that are above a certain grain size are supplied directly to further comminution. In contrast to the prior art, it is thus possible to realize a significantly greater degree of efficiency with the optimum percentage of fine-grained material.

A preferred feature of the method according to the invention is characterized in that the stream of air or gas is directed vertically from the bottom to the top and the fine-grained comminution products which have a grain size of [<] less than 5 mm are discharged in the upper region of the comminution device while the coarser grains are circulated until the desired degree of comminution has been attained. Preferably the material is piled in a circular ring-shaped pile so that the comminution work can be effected along the entire circumference of the pre-comminution and the post-comminution devices.

According to a further idea of the invention, the stream of air is generated by a fan provided downstream of the separator device, with the air being circulated. As an alternative it is possible to generate the stream of air by a blower which pushes fresh air or hot gas from a process connected upstream and/or downstream into the region of the comminution device.

It is further conceivable for the fine material, whose grain sizes are delimited according to the flow velocity, is charged directly without prior separation in a stream of air into a further, subsequently connected comminution apparatus, particularly a ball mill. Since the pre- and post-comminution already produce a very good grain size range of [<] less than 5 mm, it is possible, for example, to omit the first stag in the ball mill which is the stage provided with the coarse grinding bodies. The ball mill as a whole then has a shorter structure and requires less energy. Preferably the conveying air may simultaneously be used as mill scavenging air.

[With respect to the apparatus, the invention is characterized by the] The apparatus according to the invention for the comminution of bulk materials includes a combination of a vertical impact crusher with a separator in conjunction with a [quantity of air or gas which flows vertically through the mill from the bottom to the top and removes the fine-grained comminution products. The vertical impact crusher and the separator are preferably disposed within the same housing, with the blower of the vertical impact crusher possibly being seated in the manner of a building block on the housing of the separator.

According to a further idea of the invention, the] device for removing the fine-grained comminution products, with the housing of the vertical impact crusher being placed onto the housing of the separator in the manner of building blocks. In each case, the device includes at least one accelerator wheel disposed in the vertical impact crusher and in the separator, with these accelerator wheels being arranged axially above one another but being drivable separately. The material is first supplied to the accelerator wheel of the vertical impact crusher and then in countercurrent to the accelerator wheel of the separator. [The remainder of the specification is unchanged, except for the symbols "<" and ">" being changed to less than and greater than, respectively.]

I claim:

1. A method of comminuting bulk materials in a comminuting apparatus, the method comprising:

introducing a bulk material vertically from the top into a first accelerator device of the comminuting apparatus;

forming fine-grained comminution products and a first pile of coarse-grained material with the first accelerator device;

carrying off the fine-grained comminution products by means of a first upwardly directed stream, the coarse-grained material in the first pile flowing downward to a bottom of the comminuting apparatus;

introducing the coarse-grained material at the bottom of the comminuting apparatus by means of a second upwardly directed stream into a second accelerator device arranged beneath the first accelerator device;

forming further fine-grained comminution products and a second pile of coarse-grained material with the second accelerator device, the second pile of coarse-grained materials surrounding the second accelerator device;

carrying off the further fine-grained comminution products by means of the first upwardly directed stream, the coarse-grained material in the second pile flowing downward to the bottom of the comminuting apparatus; and returning to the step of introducing the coarse-grained material at the bottom of the comminuting apparatus into the second accelerator device by the second upwardly directed stream.

2. A method according to claim 1, wherein the steps of carrying off the fine-grained comminution products comprise carrying off and discharging material of a grain size less than 5 mm above the first accelerator device, whereby the coarse-grained material is processed continuously until a desired degree of comminution has been attained.

3. A method according to claim 1, further comprising generating the first and second streams downstream of the comminuting apparatus.

4. A method according to claim 3, wherein generating the first and second streams comprises blowing a gas from one of a preceding and a subsequent process into the comminution apparatus.

5. A method according to claim 1, further comprising carrying off the fine-grained material directly without prior separation into a further subsequently connected comminution apparatus.

6. A method according to claim 5, further comprising using mill scavenging air for carrying off the fine-grained material.

7. An apparatus for comminuting bulk materials, comprising:

a vertical impact crusher and a separator; and discharge means for discharging fine-grained comminution products produced by the vertical impact crusher and the separator, the discharge means being disposed above the vertical impact crusher to carry away by means of an upwardly directed stream the fine-grained comminution products, wherein a housing of the vertical impact crusher is disposed on a housing of the separator in the manner of building blocks;

wherein the vertical impact crusher and the separator are each provided with a plurality of accelerator wheels;

wherein at least one of the accelerator wheels in the vertical impact crusher and the accelerator wheels in the separator, respectively, are arranged axially, one on top of the other, but are capable of being driven separately; and wherein bulk material is first fed to an accelerator wheel of the vertical impact crusher and subsequently coarse material from the vertical impact crusher is fed, in an opposite direction, to an accelerator wheel of the separator.

8. An apparatus according to claim 7, wherein the bulk material to be comminuted is fed into the vertical impact crusher by way of a cellular wheel sluice and a down pipe.

9. An apparatus according to claim 7, further comprising an injector configured as a riser pipe disposed below a separator accelerator wheel.

10. An apparatus according to claim 9, wherein the riser pipe concentrically surrounds a drive shaft of the separator accelerator wheels.

11. An apparatus according to claim 7, further comprising at least one pipe connection disposed in a lower region of the separator for supplying a stream of at least one of air and gas, and at least one pipe connection disposed adjacent to the separator and the vertical impact crusher for discharging the fine-grained comminution products.

12. An apparatus for comminuting a bulk material comprising:

a housing having upper, middle and lower chambers;

cellular wheel sluice and down pipe means, connected to an upper portion of said housing, for conveying the bulk material to said housing;

intake means, connected to a lower portion of said housing, for providing first and second upwardly directed streams of air into said housing;

first accelerating mans, disposed in said housing, for receiving the bulk material from said cellular wheel sluice and down pipe means and expelling the material therefrom into the upper chamber of said housing thereby forming fine-grained particles and a first pile of coarse-grained material, the first pile of coarse-grained material flowing by means of gravity from the upper chamber to the bottom chamber of said housing;

discharge means, connected to said housing, for carrying off said fine-grained particles from said upper chamber by means of said first stream of air; and second accelerating means, disposed in said housing below said first accelerating means, for receiving said coarse-grained material from said bottom chamber of said housing by means of said second stream of air and expelling the material therefrom into the middle chamber of said housing thereby forming further fine-grained particles and a second pile of coarse-grained material, the second pile of coarse-grained material flowing by means of gravity to the bottom chamber of said housing, the further fine-grained particles being carried off from said middle chamber by means of said first stream of air.

13. The apparatus according to claim 12, further comprising a rotating central shaft and a riser pipe extending from the bottom portion of said housing;

wherein said first and second accelerating means comprise respective accelerating wheels coupled to said rotating central shaft; and wherein said second stream of air flows through said riser pipe whereby material is conveyed from said bottom chamber to said second accelerating means through said riser pipe.

* * * * *